US005387362A

United States Patent [19]

Tollens et al.

[11] Patent Number: 5,387,362

[45] Date of Patent: Feb. 7, 1995

[54] PERSONAL CLEANSING BAR WITH TAILORED BASE SOAPS WITH MIXED COUNTERIONS FOR IMPROVED MILDNESS AND PROCESSABILITY WITHOUT LATHER NEGATIVES

[75] Inventors: Fernando R. Tollens, Cincinnati; Philip J. Kefauver, Loveland; Scott W. Syfert, Cincinnati, all of Ohio

[73] Assignee: The Procter & Gamble Company, Cincinnati, Ohio

[21] Appl. No.: 959,876

[22] Filed: Oct. 13, 1992

[51] Int. Cl.[6] ..... C11D 13/18; C11D 9/30

[52] U.S. Cl. ..... 252/108; 252/117; 252/132; 252/134; 252/174.17; 252/174.23; 252/121; 252/DIG. 16

[58] Field of Search ..... 252/108, 117, 132, 547, 252/134, 174.17, 174.23, 121, DIG. 16

[56] References Cited

U.S. PATENT DOCUMENTS

| | | | |
|---|---|---|---|
| 2,970,116 | 1/1961 | Kelly et al. | 252/368 |
| 3,247,121 | 4/1966 | Hendricks | 252/117 |
| 3,640,882 | 2/1972 | Groves, Jr. | 252/121 |
| 3,835,058 | 9/1974 | White | 252/121 |
| 4,265,778 | 5/1981 | Sonenstein | 252/117 |
| 4,285,826 | 8/1981 | Bertozzi et al. | 252/117 |
| 4,493,786 | 1/1985 | Joshi et al. | 252/368 |
| 4,557,853 | 12/1985 | Collins | 252/128 |
| 4,719,030 | 1/1988 | Williams et al. | 252/133 |
| 4,946,618 | 8/1990 | Knochel et al. | 252/117 |
| 4,963,284 | 10/1990 | Novakovic et al. | 252/108 |

FOREIGN PATENT DOCUMENTS

| | | | |
|---|---|---|---|
| 03503062 | 1/1990 | European Pat. Off. | C11D 9/00 |
| 0507559A2 | 3/1992 | European Pat. Off. | C11D 10/04 |
| 57-030798 | 2/1982 | Japan | C11D 9/02 |

*Primary Examiner*—Paul Lieberman
*Assistant Examiner*—Necholus Ogden
*Attorney, Agent, or Firm*—Leonard Williamson

[57] ABSTRACT

The present invention relates to personal cleansing bar made with a base soap tailored with mixed counterions (Mg/K/Na) and selected saturated $C_{14}$–$C_{18}$ fatty acid soaps and soap selected from lauric, oleic, and other minor selected more soluble soaps. The personal cleansing bar of this invention has improved mildness while maintaining acceptable lathering/sudsing, rinsing and processing characteristics.

3 Claims, 1 Drawing Sheet

PERSONAL CLEANSING BAR WITH TAILORED BASE SOAPS WITH MIXED COUNTERIONS FOR IMPROVED MILDNESS AND PROCESSABILITY WITHOUT LATHER NEGATIVES

TECHNICAL FIELD

This invention relates to mild personal cleansing bar soaps.

BACKGROUND OF THE INVENTION

The cleansing of skin with surface-active cleansing preparations has become a focus of great interest. Many people, particularly, urban Americans, wash and scrub their skin with various surface-active preparations several times a day. Ideal skin cleansers should cleanse the skin gently, causing little or no irritation, without defatting or overdrying the skin or leaving it taut after frequent routine use. Most lathering soaps, liquids and bars included, fail in this respect.

Synthetic detergent bars, frequently referred to as "syndet bars," are well known and are becoming increasingly popular. However, widespread replacement of soap bars by syndet bars has not so far been possible for a variety of reasons, primarily the different physical characteristics of syndet bars as compared to soap bars, e.g., smear or bar messiness, lather and rinse quality.

The soap bar literature is full of references to technology which improved bar soap mildness. However, to improve bar soap mildness without processing and/or lather negatives requires a delicate balancing act.

It will be appreciated that rather stringent requirements for skin cleansers limit the choice of surface-active agents and final formulations represent some degree of compromise. Mildness is often obtained at the expense of effective cleansing and lathering. Conversely, mildness may be sacrificed for either preferred lathering characteristics, bar firmness, product stability, or all of these.

SUMMARY OF THE INVENTION

Figure 1:
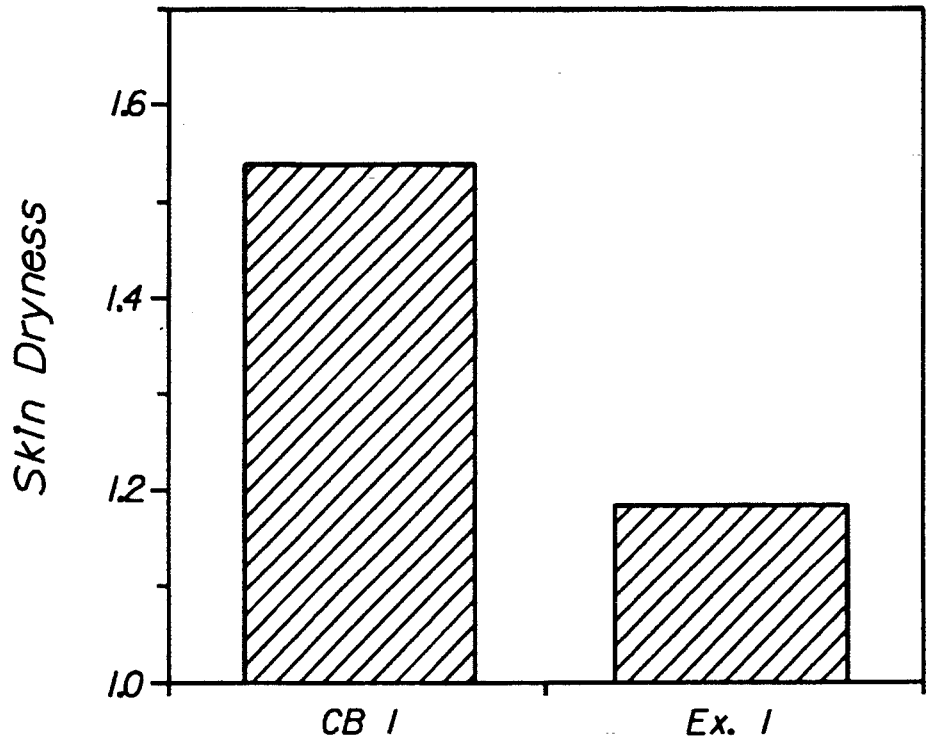
FIG. 1 graphically shows skin dryness results for Comparative Bar I vs. Example 1. The lower the number, the better for skin mildness.

The present invention relates to a personal cleansing bar made with a base soap tailored with mixed counterions (Mg/K/Na) and selected saturated $C_{14}$–$C_{18}$ fatty acid soaps and soap selected from lauric, oleic, and other minor more soluble soaps. The personal cleansing bar of this invention has improved mildness while maintaining acceptable lathering/sudsing, rinsing and processing characteristics.

OBJECT OF THE INVENTION

It is an object of the present invention to provide a mild, good lathering base soap that can be made using a freezer, mill or frame bar soap process.

Another object is to provide a tailored bar soap that is milder than the current standards.

Still another object is to provide a mild, good lathering base soap which can be easily blended with synthetic surfactants, polymers, antibacterials, etc.

Yet another object of the present invention is to provide a good lathering bar without impairing mildness.

Other objects of the present invention will be apparent in the light of the following disclosure.

DETAILED DESCRIPTION OF THE INVENTION

The present invention relates to personal cleansing bar made with a base soap tailored with mixed counterions (Mg/K/Na) and selected saturated $C_{14}$–$C_{18}$ fatty acid soaps and soap selected from lauric, oleic, and other minor more soluble soaps. The personal cleansing bar of this invention has improved mildness while maintaining acceptable lathering/sudsing, rinsing and processing characteristics.

Freezer bar soaps can be made using a process generally disclosed in U.S. Pat. No. 3,835,058, White. Milled and framed bars are made using processes known in the art. The bars of the present invention are highly desirable from the standpoint of skin mildness and processability while maintaining other acceptable bar qualities including good sudsing and/or good smear characteristics.

The levels, parts, percentages and ratios herein are by weight unless otherwise specified. Note that the levels of the soaps expressed herein are in terms of weight percent (wt. %) of the total soap and also in terms of wt. % of the bar. All numerical limits, ranges, ratios, etc., are approximations (abouts) unless otherwise specified. Within the scope of the invention, there are several different preferred embodiments. The present invention is broadly defined in Paragraph 1 as:

Paragraph 1. A mild, lathering personal cleansing soap bar comprising: from 30% to 85–90% fatty acid soap by weight of the bar; and from 5% to 35% of water by weight of the bar; Characterized in that said soap comprises:

I. from 50% to 85% by weight of total soap is saturated fatty acid soaps selected from the group consisting of: myristic, palmitic, and stearic acid soaps and mixtures thereof; and II. from 15% to 50% by weight of total soaps is selected from the group consisting of: oleic and lauric acid soaps and minor fatty acid soaps selected from the group consisting of: $C_8$, $C_{10}$, $C_{18:2}$; and mixtures thereof;

wherein by weight of the bar, said bar contains from 8% to 35% of said selected oleic and lauric soaps and minor soaps;

wherein said oleic soap level is from 0% to 25% by weight of the bar;

wherein said lauric soap level is from 0% to 12% by weight of the bar; and wherein said minor ($C_8$, $C_{10}$, $C_{18:2}$) soaps level is from 0% to 7% by weight of the bar; and wherein said lauric and oleic soaps to said minor ($C_8$, $C_{10}$, $C_{18:2}$) soaps have a ratio of from 1:1 to 1:0.1; and wherein said soap has a mixture of counterions (cations) comprising sodium, potassium and magnesium (Na/K/Mg);

wherein said Na/K soap mixture level is from 65% to 97% by weight of the total soap; and wherein said Na/K soap has a ratio of from 19:1 (95/5 ) to 1:1.5 (40/60 ); and wherein said Mg soap level is from 3% to 35% by weight of the total soap; said Na and Mg soaps have a ratio of from 20:1 to 1:1 and said K to Mg have a ratio of from 20:1 to 1:1.

Preferred Bars Defined in Paragraphs 2–5

Paragraph 2. The mild, lathering personal cleansing soap bar of Paragraph 1 wherein:

I. said saturated fatty acid soaps is a mixture of: myristic, palmitic, and stearic acid soaps; wherein, said mixture level is from 55% to 80–85%, preferably 60% to 75%, by weight of total (fatty acid) soap; and II. from 20% to 45%, preferably 25% to 40%, of total soap is said selected oleic and lauric acid soaps and minor fatty acid soaps;

wherein said bar contains from 15% to 30%, preferably 15% to 25%, of said selected oleic and lauric soap, and minor ($C_8$, $C_{10}$, $C_{18:2}$) soaps;

wherein said oleic soap level is from 5% to 20%, preferably 10% to 15%, by weight of the bar;

said lauric soap is from 5% to 12%, preferably 7% to 10%, by weight of said bar; and wherein said minor ($C_8$, $C_{10}$, $C_{18:2}$) soap level is from 2% to 5% by weight of said bar; and wherein said Na/K soap mixture level is from 65% to 90%, preferably 70% to 80%, by weight of said total soap; and wherein said Na/K soap has a ratio of from 90/10 to 65/35, preferably 2/1 to 1:1; and wherein said Mg soap level is from 5% to 25%, preferably 10% to 20%, by weight of the total soap; and wherein said soap bar comprises by weight of said bar:

A. from 60% to 85%, preferably 65% to 75%, alternatively 65% to 82%, of said total fatty acid soap;

B. from 0% to 15%, preferably 0.25% to 10% of free fatty acid; and

C. from 5% to 30%, preferably 20% to 28%, alternatively 10% to 25% of said water;

D. from 0% to 3% of a polymeric skin feel aid.

Paragraph 3. The mild, lathering soap bar of Paragraph 1 wherein said water level is from 5–20%, preferably 10–15%; wherein the total fatty acid soap level is 70% to 85–90% by weight of the bar; and wherein the sum level of said lauric and said oleic acid soaps is from 15% to 30% by weight of said bar and the ratio of said lauric/oleic acids is from 1.5:1 to 1:3 and wherein said Na/K ratio is from 85/15 to 60/40; said Mg soap level is from 5% to 20%, preferably 5% to 15%, by weight of the total soap; and wherein said bar is a milled bar.

Paragraph 4. The mild, lathering soap bar of Paragraphs 1, 2, or 3 wherein said bar contains from 4% to 30%, preferably 8% to 20%, more preferably 10% to 15%, of a mild lathering synthetic surfactant.

Paragraph 5. The mild lathering soap bar of Paragraphs 2, 3, and 4, wherein said bar contains from 0.1% to 30%, preferably 0.25% to 10%, of said polymeric skin feel aid.

The Tailored Base Soap

The tailored fatty acid base soap of the present invention is defined in Paragraphs 1–3. The sodium and potassium ion soaps, as defined above, are required for lather. The insoluble magnesium ion soap is required for mildness and processability. The levels and ratios as set out in Paragraphs 1–3 insure bar mildness, lather, rinsability and processability. Other cations, e.g. triethanol ammonium (TEA), with similar properties can be used, at least in small amounts.

The terms "total soap" and "total fatty acid soap" as used herein are the same.

The term "insoluble" soap as used herein means soap less soluble than sodium myristate ($C_{14}$). The magnesium soaps are insoluble. See Table 1.

TABLE 1

| | Solubility of Soaps, Molar, 25° C. | | |
|---|---|---|---|
| | Na | K | Mg |
| $C_{12}$ | 0.11 | Freely | Insoluble |
| $C_{18:1}$ | 0.49 | Freely | — |
| $C_{14}$ | 0.004 | Freely | Insoluble |
| $C_{16}$ | Insoluble | — | Insoluble |
| $C_{18}$ | Insoluble | — | Insoluble |

The term "soap" as used herein includes the plural as well as the singular in terms of mixed ions and fatty acid chains unless otherwise specified.

The term "coconut oil" (CNO) as used herein in connection with soap or fatty acid mixtures refers to materials having an approximate carbon chain length distribution of: 8% $C_8$; 7% $C_{10}$; 48% $C_{12}$; 17% $C_{14}$; 9% $C_{16}$; 2% $C_{18}$; 7% $C_{18:1}$ oleic and 2% linoleic (the first six fatty acids being saturated).

The term "palm kernel oil" (PKO) as used herein in connection with soap or fatty acid mixtures refers to materials having an approximate carbon chain length distribution of: 3% $C_8$; 3% $C_{10}$; 47% $C_{12}$; 17% $C_{14}$; 9% $C_{16}$; 3% $C_{18}$; 16% $C_{18:1}$ oleic and 3% linoleic (the first six fatty acids being saturated).

The term "palm oil stearin" (POS) as used herein refers to materials having an approximate carbon chain length distribution of about: 1% $C_{14}$, 58% $C_{16}$, 5% $C_{18}$, 29% oleic, and 7% linoleic (the first three fatty acids being saturated).

The term "tallow" (T) as used herein refers to a mixture of soaps having an approximate chain length distribution of: 2.5% $C_{14}$; 29% $C_{16}$; 23% $C_{18}$; 2% palmitoleic; 41.5% oleic and 3% linoleic.

The term "triple pressed stearic" as used herein refers to fatty acids having an approximate chain length distribution of 55% palmitic, $C_{16}$, 45% stearic, $C_{18}$.

The term "relatively more soluble soap" as used herein means a soap of which the fatty chain length or level of unsaturation is such that it is more soluble than sodium myristate, or a soap that has the solubility on the order of sodium laurate or sodium oleate soaps.

The tailored fatty acid soap of this invention can be made using pure chain fatty acids, or by using the proper levels and ratios of common fatty acid mixtures such as coconut, palm oil stearin, tallow, and triple pressed stearic. The preferred levels and ratios can vary with the levels of cation mixtures.

The levels of potassium soap preferably should not exceed about one-half that of the total soap; the level of any TEA should not exceed about one-third of the level of the total soap and the level of magnesium soap or calcium soap should not exceed about three-tenths of the level of total soap. E.g., the sodium soap is preferably at least about 40% of the total soap present in the bar.

Better lather is achieved by using more $C_{18:1}$ cis and potassium cation soaps. The use of the $C_{18:1}$ cis vs. the $C_{18:1}$ trans, and K vs. Na soaps increase soap solubility and are not as adverse to mildness.

It is important to selectively balance the amount of more water-soluble lauric and oleic soaps and minor, more water-soluble soaps to from 8–30% by weight of the bar to achieve good lather and mildness. More lather is realized at the higher end of the level (30%) and better mildness is realized at the lower (8%) end of the level.

Free Fatty Acids

Free fatty acids are preferably used in the present invention. They correspond with the fatty acids used to make the soaps. The free fatty acids affect the lathering characteristics of the bars prepared in accordance with the present invention. The free fatty acids increase the creaminess of the lather; the bars of this invention can show a mildness improvement over bars without free fatty acids. Fatty acids provide an emollient effect which tends to soften the skin or otherwise improve feel-on-skin characteristics and scavenge any excess alkalinity.

Synthetic Detergent Surfactant

An alternative bar can contain synthetic detergent surfactant, preferably a mild lathering synthetic detergent surfactant; however, the bars of this invention are preferably soap bars with little or no synthetic surfactant.

The optional synthetic detergent surfactant is typically selected from the group consisting of: anionic, nonionic, amphoteric and zwitterionic synthetic detergents. Both low and high lathering and high and low water-soluble surfactants can be used in the bar compositions of the present invention. Suds boosting synthetic detergent surfactants and/or synthetic detergent surfactants that are known as good dispersants for soap curds that are formed in hard water, are particularly desirable.

Examples include the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm oil, palm kernel oil, palm oil stearin, babassu kernel oil or other oils of the lauric oil group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

The synthetic surfactants and other optional materials useful in conventional cleaning products are also useful in the present invention. In fact, some ingredients such as certain hygroscopic synthetic surfactants which are normally used in liquids and which are very difficult to incorporate into normal cleansing bars are very compatible in the bars of the present invention. Thus, essentially all of the known synthetic surfactants which are useful in cleansing products are useful in the compositions of the present invention. The cleansing product patent literature is full of synthetic surfactant disclosures.

It is noted that surfactant mildness can be measured by a skin barrier destruction test which is used to assess the irritancy potential of surfactants. In this test the milder the surfactant, the less the skin barrier is destroyed. Skin barrier destruction is measured by the relative amount of radio-labeled water ($^3H—H_2O$) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference. These references disclose a mild alkyl glyceryl ether sulfonate (AGS) surfactant based synbar comprising a "standard" alkyl glyceryl ether sulfonate mixture and define the criteria for a "mild surfactant." Barrier destruction testing is used to select mild surfactants. Some preferred mild synthetic surfactants are disclosed in the above Small et al. and Rys et al. patents. Some specific examples of preferred surfactants are used in the Examples herein.

Some examples of good mild, lather-enhancing, synthetic detergent surfactants are, e.g., sodium lauroyl sarcosinate, alkyl glyceryl ether sulfonate (AGS), sulfonated fatty esters, and sulfonated fatty acids. Numerous examples of other surfactants are disclosed in the patents incorporated herein by reference. They include other alkyl sulfates, anionic acyl sarcosinates, methyl acyl taurates, N-acyl glutamates, acyl isethionates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Included in the surfactants are the alkyl ether sulfates with 1 to 12 ethoxy groups, especially ammonium and sodium lauryl ether sulfates.

Alkyl chains for these other surfactants are $C_8$–$C_{22}$, preferably $C_{10}$–$C_{18}$. Alkyl glycosides and methyl glucose esters are preferred mild nonionics which can be mixed with other mild anionic or amphoteric surfactants in the compositions of this invention. Alkyl polyglycoside detergents are useful lather enhancers.

Normally the soap/synthetic bars are prepared to contain a ratio of soap to synthetic detergent of from about 3:1 to about 25:1. The choice of suitable ratios will depend upon the particular synthetic detergent, the desired performance and physical characteristics of the finished bar, temperature, moisture and like processing considerations. A preferred ratio is from about 4:1 to about 7:1.

Polymers

A highly preferred embodiment of the present invention contains a polymeric skin mildness aid. Polymeric skin mildness aids are disclosed in the Small et al. and Medcalf et al. patents. (U.S. Pat. Nos. 4,673,525; 4,812,258; and 4,820,447 incorporated herein by reference.) The cationic synthetic polymers useful in the present invention are cationic polyalkylene imines, ethoxypolyalklene imines, and poly[N-[-3-(dimethylammonio)propyl]- N'-[3-(ethyleneoxyethylene dimethylammonio)propyl]urea dichloride] the latter of which is available from Miranol Chemical Company, Inc. under the trademark of Miranol A-15, CAS Reg. No. 68555-36-2.

Preferred cationic polymeric skin conditioning agents of the present invention are those cationic polysaccharides of the cationic guar gum class with molecular weights of 1,000 to 3,000,000. More preferred molecular weights are from 2,500 to 350,000. These polymers have a polysaccharide backbone comprised of galactomannan units and a degree of cationic substitution ranging from about 0.04 per anhydroglucose unit to about 0.80 per anhydroglucose unit with the substituent cationic group being the adduct of 2,3-epoxypropyltrimethyl ammonium chloride to the natural polysaccharide backbone. Examples are JAGUAR C-14-S, C-15 and C-17 sold by the successor of the Celanese Corporation. In order to achieve the benefits described in this invention, the polymer must have characteristics, either structural or physical which allow it to be suitably and fully hydrated and subsequently well incorporated into the soap matrix.

Other Ingredients

The bar soap compositions of the present invention can contain other additives commonly included in toilet bars such as perfumes, other fillers, sanitizing or antimicrobial agents, dyes, and the like.

Preservatives, e.g., sodium ethylenediaminetetraacetate (EDTA), generally at a level of less than 1% of the composition, can be incorporated in the cleansing products to prevent color and odor degradation. Antibacterials can also be incorporated, usually at levels up to 1.5%. The above patents disclose or refer to such ingredients and formulations which can be used in the bars of this invention, and are incorporated herein by reference.

Some bars of this invention contain at least about 1% of another bar ingredient selected from: moisturizers, colorants, solvents, fillers, synthetic detergent surfactants, polymeric skin feel and mildness aids, perfumes, preservatives, and mixtures thereof.

Compatible salt and salt hydrates can be incorporated into the formulation. Some preferred salts are sodium chloride, sodium sulfate, disodium hydrogen phosphate, sodium pyrophosphate, sodium tetraborate. Sodium chloride is kept below 2.0% by weight of the bar, preferably less than 1%.

EXAMPLES

The following Examples illustrate the practice of this invention and are not intended to be limiting. All percentages, parts and ratios herein are by weight unless otherwise specified. All levels and ranges, temperatures, results etc., used. herein are approximations unless otherwise specified. The free fatty acids used in the examples are used at about the same ratio as the fatty acid soaps. The soaps are made in situ, unless otherwise specified. The levels of soaps are given as a total soap weight percent (wt. %), as well as a bar weight percent (wt. %).

COMPARATIVE BAR I VS. EXAMPLE 1-FREEZER BARS
Approximate Chain Length Distribution (Wt. %)
(The percent by weight of total soap is given parenthetically)

| | Comparative Bar I (CB) | | Example 1 | |
|---|---|---|---|---|
| Na/K/Mg | 80/20/0 | | 64/24/12 | |
| Ingredient | In Bar Wt. % | In Soap Wt. % | In Bar Wt. % | In Soap Wt. % |
| $C_8$ | 1.30 | (1.73) | 1.33 | (1.94) |
| $C_{10}$ | 1.10 | (1.47) | 1.09 | (1.59) |
| $C_{12}$ | 9.40 | (12.53) | 8.75 | (12.73) |
| $C_{14}$ | 6.00 | (8.00) | 4.08 | (5.94) |
| $C_{16}$ | 16.80 | (22.40) | 30.00 | (43.66) |
| $C_{18}$ | 13.60 | (18.13) | 11.95 | (17.39) |
| $C_{18:1}$ | 24.90 | (33.20) | 10.45 | (15.21) |
| $C_{18:2}$ | 1.90 | (2.53) | 1.07 | (1.55) |
| Total Soap | 75.00 | | 68.72 | |
| Water | 23.25 | | 26.00 | |
| FFA (same as soap) | — | | 4.0 | |
| Free Caustic | 0.5 | | — | |
| NaCl | 0.8 | | 0.8 | |
| Minors (Perfumes, Preservatives) | 0.45 | | 0.48 | |
| Totals | 100.00 | | 100.00 | |

These freezer soap bar compositions are mixed at a temperature of about 190° F. (88° C.) and pumped into a scraped wall heat exchanger where the temperature of the mix is cooled to about 130° F. (55° C.) and where the mix is aerated. The aerated and cooled soap mix is then extruded and bar plugs are cut and conditioned. The final bars are then stamped.

Example 1, the best overall bar, contains Na/K/Mg counterions at the levels of 64/24/12 by weight of the soap. CB-I contains only Na/K soaps at levels of 80/20. See FIG. 1.

Example 1 is significantly milder than the Comparative Bar I (CB-I), in an exaggerated forearm wash test, and is about as mild as a very mild, commercially available combo bar, Neutrogena ® Dry Skin Formula:

Approximate Neutrogena ® Formula

| Ingredient | Wt. % |
|---|---|
| Na 80T/20Cn Soap | 30 |
| TEA 80T/20Cn Soap | 30 |
| Free TEA | 15 |
| Glycerine | 10 |
| Nonionic Surfactant | 8.4 |
| Water | 5.5 |
| Minors | 1.1 |
| Total | 100.0 |

The exaggerated forearm wash test is a modified Lukacovic, Dunlap, Michaels, Visscher, and Watson: "Forearm wash test to evaluate the clinical mildness of cleansing products," J. Soc. Cosmet. Chem., 39, 355–366 (November/December 1988). One week of testing is used instead of two weeks.

Advantages of Example 1 versus the Comparative Bar I and other mild bars are:

1. Example 1 is much milder than the Comparative Bar (CB-I).
2. Their lather volumes are about the same (usually milder bars lather much less).
3. Example 1 has a lather creaminess equal to CB-I.
4. Example 1 is made using a similar freezer process.

5. Example 1 does not wear away as fast as other bars in its mildness class (e.g., Neutrogena®) and is even better than CB-I.
6. Example 1 contains more soap than other bars in its mildness class.

The major differences between CB-I and Example 1 are:

(1) CB-I is a free caustic bar and Example 1 has 4.0% FFA. (2) Example 1 contains 8.5% Mg soap. CB-I contains none. (3) CB-I has $C_{12}$ soap at 9.4% in bar, and Example 1 has $C_{12}$ at 8.75% (delta is 0.65% by wt. % of bar). (4) CB-I has $C_{18:1}$ at 24.9% by wt. % of bar, and Example 1 has $C_{18:1}$ at about 10.45% by wt. % of bar (delta is 14.45%). (5) The $C_{18:1}$ in Example 1 is substantially all cis isomer. The trans/cis content of the $C_{18:1}$ in "CB-I" is 60/40. (6) The Comparative Bar (CB-I) contains a total of about 75% soap by weight of the bar and the $C_{12}$ and $C_{18:1}$ content by weight of total soap is 45.7% (12.5% and 33.5%) vs. Example 1 with 68.72% total soap and 27.94% ($C_{12}$ and $C_{18:1}$).

7. Example 1 has a better, more soap-like rinse feel than other bars in its mildness class.

A mild, lathering personal cleansing soap bar comprising: from 68.72% fatty acid soap by weight of the bar; and from 26.0% of water by weight of the bar; Characterized in that said soap comprises:

I. 66.99% by weight of total soap of myristic, palmitic, and stearic acid soaps; and II. 33.01% by weight of total soaps is oleic and lauric acid soaps and minor fatty acid soaps ($C_8$, $C_{10}$, $C_{18:2}$);

wherein by weight of the bar, said bar contains 22.69% of oleic and lauric soaps and minor soaps;

the oleic soap level is 10.45% by weight of the bar;

the lauric soap level is 8.75% by weight of the bar; and the minor ($C_8$, $C_{10}$, $C_{18:2}$) soaps level is 3.49% by weight of the bar; and the lauric and oleic soaps to said minor ($C_8$, $C_{10}$, $C_{18:2}$) soaps have a ratio of 1:0.13; and the soap has a mixture of counterions (cations) comprising sodium, potassium and magnesium (Na/K/Mg) (64/24/12);

the Na/K soap mixture level is 88% by weight of the total soap; and the Na/K soap has a ratio of 2.67:1; and the Mg soap level is 12% by weight of the total soap; said Na and Mg soaps ratio is 5.3:1 and said K to Mg ratio is 2:1.

MILLED SOAP BARS
Approximate Chain Length Distribution (Wt. %)
(The percent by weight of total soap is given parenthetically)

| | Comparative Bar I (CB) | | Example 1 | |
|---|---|---|---|---|
| Na/K/Mg | 100% Na | | 64/24/12 | |
| Ingredient | In Bar Wt. % | In Soap Wt. % | In Bar Wt. % | In Soap Wt. % |
| $C_8$ | 0.99 | (1.28) | 0.56 | (0.70) |
| $C_{10}$ | 1.00 | (1.30) | 0.55 | (0.68) |
| $C_{12}$ | 14.78 | (19.2) | 8.45 | (10.44) |
| $C_{14}$ | 6.17 | (8.01) | 3.68 | (4.55) |
| $C_{16}$ | 20.77 | (26.97) | 35.70 | (44.09) |
| $C_{18}$ | 8.14 | (10.57) | 18.05 | (22.29) |
| $C_{18:1}$ | 21.46 | (27.87) | 11.34 | (14.00) |
| $C_{18:2}$ | 2.43 | (3.16) | 1.58 | (1.96) |

-continued

MILLED SOAP BARS
Approximate Chain Length Distribution (Wt. %)
(The percent by weight of total soap is given parenthetically)

| | Comparative Bar I (CB) | | Example 1 | |
|---|---|---|---|---|
| Na/K/Mg | 100% Na | | 64/24/12 | |
| Ingredient | In Bar Wt. % | In Soap Wt. % | In Bar Wt. % | In Soap Wt. % |
| Total Soap | 75.74 | | 80.98 | |
| Water | 14.0 | | 12.0 | |
| $TiO_2$ | 0.4 | | 0.4 | |
| Triclorocarbon | 1.5 | | 0.25 | |
| FFA (same as soap) | 5.8 | | 4.00 | |
| NaCl | 1.2 | | 1.0 | |
| Minors (Perfumes, (Preservatives) | 1.36 | | 1.37 | |
| Totals | 100.00 | | 100.00 | |

Example 2 is a milled bar with more soap than CB-II—a standard milled bar; yet Example 2 is milder than CB-II and is equal in lather. Example 2 is as mild as Neutrogena® Dry Skin Formula, and was significantly milder than a commercially available deodorant bar Dial®, White Version.

Figure 2:
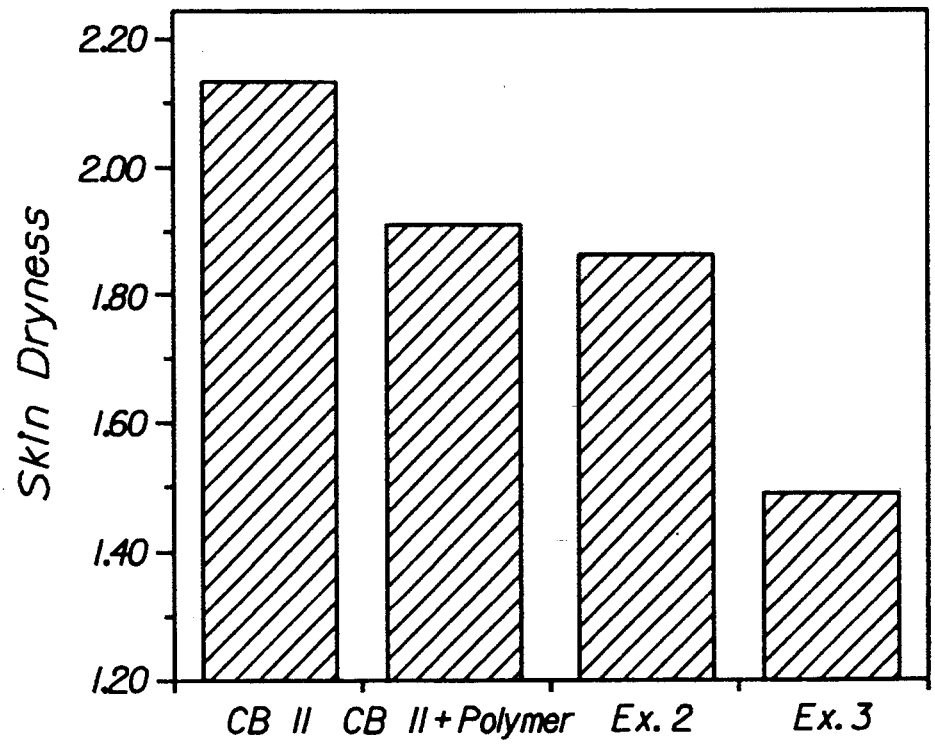
FIG. 2 graphically shows clinical dryness results for Comparative Bar II vs. Comparative Bar II with polymer vs. Example 2 vs. Example 3 with polymer.

See FIG. 2 for a graphic illustration of the mildness (dryness) results of CB-II vs. CB-II plus polymer (1% Jaguar 376A) vs. Example 2 vs. Example 3 with 0.5% Jaguar 376A. The tailored base soap of the present invention is surprisingly milder than that of CB-II without a lather negative.

Approximate Dial® Formula

| Ingredient | Wt. % |
|---|---|
| Na 75T/3POS/22PKO | 80.5 |
| FFA | 2.2 |
| Glycerine | 2.3 |
| PEG-6 | 4.0 |
| Water | 10.3 |
| Minors | 0.7 |
| Total | 100.0 |

BAR WITH POLYMER
Approximate Chain Length Distribution (Wt. %)
(The percent by weight of total soap is given parenthetically)

| | Example 3 Milled | |
|---|---|---|
| Na/K/Mg | 64/24/12 | |
| Ingredient | In Bar Wt. % | In Soap Wt. % |
| $C_8$ | 0.64 | (0.80) |
| $C_{10}$ | 0.62 | (0.78) |
| $C_{12}$ | 9.54 | (11.86) |
| $C_{14}$ | 4.07 | ( 5.05) |
| $C_{16}$ | 34.28 | (42.6 ) |
| $C_{18}$ | 16.04 | (19.93) |
| $C_{18:1}$ | 12.53 | (15.57) |
| $C_{18:2}$ | 1.75 | (2.18) |
| Total Soap | 80.48 | |
| Water | 12.00 | |
| $TiO_2$ | 0.4 | |
| Triclorocarbons | 0.25 | |
| Polymer Jaguar 376A* | 0.5 | |
| NaCl | 1.0 | |
| FFA (same as soap) | 4.00 | |
| Minors | 1.37 | |
| Totals | 100.00 | |

*A fast hydrating cationic guar polymer.

Example 3 is a Milled bar which is very mild. This bar contains a polymeric skin feel aid which provides additional surprising unexpected results.

SOAP/SYNTHETIC BAR EXAMPLES
Approximate Chain Length Distribution (Wt. %)
(The percent by weight of total soap is given parenthetically)

| Na/K/Mg | Example 4 64/24/12 | | Example 5 64/24/12 | |
|---|---|---|---|---|
| Ingredient | In Bar Wt. % | In Soap Wt. % | In Bar Wt. % | In Soap Wt. % |
| $C_8$ | 0.48 | (0.64) | 0.43 | (0.73) |
| $C_{10}$ | 0.47 | (0.62) | 0.41 | (0.71) |
| $C_{12}$ | 7.17 | (9.56) | 6.38 | (10.88) |
| $C_{14}$ | 3.32 | (4.42) | 2.85 | (4.86) |
| $C_{16}$ | 33.16 | (44.21) | 25.17 | (42.94) |
| $C_{18}$ | 10.26 | (13.68) | 7.51 | (12.80) |
| $C_{18:1}$ | 16.86 | (22.52) | 13.33 | (22.73) |
| $C_{18:2}$ | 2.32 | (3.09) | 1.84 | (3.13) |
| Total Soap | 75.0 | | 58.52 | |
| Water | 12.00 | | 26.00 | |
| AGS | 10.00 | | 10.00 | |
| NaCl | 0.9 | | 1.0 | |
| FFA (same as soap) | 0.5 | | 4.0 | |
| Minors | 1.60 | | 0.48 | |
| Totals | 100.00 | | 100.00 | |

Example 4 is a tailored soap/synthetic milled bar and Example 5 is a tailored soap/synthetic Freezer bar. Both of these bars are milder than comparable bars made with non-tailored soap. The bathtub ring is reduced for both of these bars.

FRAME BAR EXAMPLE
Approximate Chain Length Distribution (Wt. %)
(The percent by weight of total soap is given parenthetically)

| Na/K/Mg | Example 6 45/40/15 | |
|---|---|---|
| Ingredient | In Bar Wt. % | In Soap Wt. % |
| $C_8$ | 0.55 | (0.77) |
| $C_{10}$ | 0.54 | (0.74) |
| $C_{12}$ | 8.26 | (11.44) |
| $C_{14}$ | 3.64 | (5.04) |
| $C_{16}$ | 30.66 | (42.46) |
| $C_{18}$ | 9.58 | (13.27) |
| $C_{18:1}$ | 15.91 | (22.04) |
| $C_{18:2}$ | 2.2 | (3.04) |
| Total Soap | 72.0 | |
| Water | 26.00 | |
| NaCl | 1.00 | |
| FFA (same as soap) | 0.5 | |
| Minors | 0.5 | |
| Totals | 100.00 | |

Example 6 is a framed bar made with the tailored soap of this invention. It is milder than a comparable bar made with non-tailored soap.

The personal cleansing bars made with the carefully tailored base soap with the mixed counterions (Mg/K/Na) and selected fatty acids of the present invention have improved mildness over comparable bars made with standard base soaps. The bars of the present invention surprisingly have little or no lather negative, good rinse feel and good processability, good wear rate, and good smear. The bars of the present invention should cleanse the skin gently, causing little or no irritation and with less drying.

What is claimed is:

1. A personal cleansing soap bar composition comprising: A mixture of sodium, potassium and magnesium soaps at levels of about 64%, 24% and 12%, respectively, by weights of total soap; and wherein said soaps have the following fatty acids chains:

| Fatty Acids Chains | In Bar Wt. Parts | In Soap Wt. % |
|---|---|---|
| $C_8$ | 1.33 | (1.94) |
| $C_{10}$ | 1.09 | (1.59) |
| $C_{12}$ | 8.75 | (12.73) |
| $C_{14}$ | 4.08 | (5.94) |
| $C_{16}$ | 30.00 | (43.66) |
| $C_{18}$ | 11.95 | (17.39) |
| $C_{18:1}$ | 10.45 | (15.21) |
| $C_{18:2}$ | 1.07 | (1.55) |

and wherein said bar composition has about 68 parts total soap, about 26 parts water and about 1 part salt by wt. of said bar.

2. A personal cleansing soap bar composition comprising: A mixture of sodium, potassium and magnesium soaps at levels of about 64%, 24% and 12%, respectively, by weights of total soap; and wherein said soaps have the following fatty acids chains:

| Fatty Acids Chains | In Bar Wt. Parts | In Soap Wt. % |
|---|---|---|
| $C_8$ | 0.56 | (0.70) |
| $C_{10}$ | 0.55 | (0.68) |
| $C_{12}$ | 8.45 | (10.44) |
| $C_{14}$ | 3.68 | (4.55) |
| $C_{16}$ | 35.70 | (44.09) |
| $C_{18}$ | 18.05 | (22.29) |
| $C_{18:1}$ | 11.34 | (14.00) |
| $C_{18:2}$ | 1.58 | (1.96) |

and wherein said bar composition has about 80 parts total soap, about 12 parts water, and about 1 part salt.

3. The bar composition of claim 2 wherein said composition contains about 0.5 parts catonic guar polymer.

* * * * *